United States Patent [19]

Jespersen et al.

[11] Patent Number: 4,671,466

[45] Date of Patent: Jun. 9, 1987

[54] CORE-BUCKLING TISSUE DISPENSER AND DISPENSING METHOD

[75] Inventors: Paul W. Jespersen, Herlev, Denmark; Raymond F. DeLuca, Stamford, Conn.

[73] Assignee: Georgia-Pacific Corporation, Atlanta, Ga.

[21] Appl. No.: 843,609

[22] Filed: Mar. 25, 1986

[51] Int. Cl.[4] ..... B65H 16/06; B65H 19/10

[52] U.S. Cl. ..... 242/55.3

[58] Field of Search ..... 242/55.3, 55.53; 312/38, 39, 40; 225/46, 47, 53

[56] References Cited

U.S. PATENT DOCUMENTS

| | | | |
|---|---|---|---|
| 3,039,709 | 6/1962 | Bolger | 242/55.3 |
| 3,211,504 | 10/1965 | Bump | 312/39 |
| 3,387,902 | 6/1968 | Perrin et al. | 312/39 |
| 3,437,388 | 4/1969 | Jespersen | 312/39 |
| 3,438,589 | 4/1969 | Jespersen | 242/55.2 |
| 3,572,600 | 3/1971 | Jespersen | 242/55.3 |
| 3,948,454 | 4/1976 | Bastian | 242/55.3 |
| 4,034,924 | 7/1977 | Carlisle | 242/55.3 |
| 4,383,657 | 5/1983 | Suh | 242/55.3 |
| 4,522,346 | 6/1985 | Jespersen | 242/55.3 |

*Primary Examiner*—John M. Jillions

*Attorney, Agent, or Firm*—Banner, Birch, McKie & Beckett

[57] ABSTRACT

A dispenser and dispensing method for flexible web material that is wound into a roll on a readily deformable hollow core has a housing carrying opposed parallel guide tracks to guidingly receive roll core supports projecting from the roll ends and a spring biased lever pivoted on such housing, the lever applying an axial force to the hollow core at one roll end and being maintained in a roll retaining condition by the presence, in a roll dispensing position, of a hollow roll core that is held against downward displacement from such position. An axial force is applied against the other end of the hollow core. The lever serves to retain a reserve roll in a reserve roll position remote from the roll dispensing position with the lever being released from such retaining condition when the web material is exhausted and the hollow core is deformed downwardly, assisted by the axial forces applied to the hollow core ends, to enable removal of this core from the roll dispensing position whereupon such reserve roll moves to the dispensing position.

8 Claims, 6 Drawing Figures

CORE-BUCKLING TISSUE DISPENSER AND DISPENSING METHOD

BACKGROUND OF THE INVENTION

This invention relates to a dispenser and dispenser method of dispensing multiple rolls of flexible web material where the material on each roll is wound on a readily deformable hollow core with core spindles projecting from the opposite ends of the core, the spindles being supported by cradles provided in the dispenser. More particularly the upper portions of the opposite ends of the core have axial forces applied thereto tending to collapse the core when the web material is exhausted from the roll.

There are many examples of toilet tissue dispensers in the prior art, reflecting a wide variety of efforts to dispense web material from dispensers capable of handling single or multiple rolls of the material. In commercial applications of these prior art dispensers varying degrees of acceptance have occurred.

Rolls of toilet tissue to be handled in these dispensers usually have the web material wound onto a cylindrical tubular core, more frequently a one piece tubular core. In some instances, a roll core support spindle is inserted in each end of this tubular hollow core so as to provide core supports projecting outwardly from each end of the roll of flexible web material. Jespersen U.S. Pat. No. 3,572,600 may be noted as exemplifying a dispenser for multiple rolls where the web material is wound on a one-piece tubular core.

In a number of the prior art dispenser concepts where the roll is to have a one-piece tubular hollow core it is contemplated that the core is to drop out of the dispenser when the web material is substantially exhausted. In these dispensers, a reserve roll within a multiple roll dispenser has been moving down on its own roll core support spindles, guidingly received in opposed tracks. This reserve roll has been resting on the lower roll during tissue dispensing from such lower roll and thus the reserve roll follows the lower roll into the dispensing position when the hollow core drops out.

With these web dispensing concepts as described above, there nearly always is some toilet tissue in the form of the web material remaining on the hollow roll core when it finally drops out of the dispenser. This not only involves a needless waste of toilet paper, but can contribute to jamming of the dispenser in the event that the core does not fully disengage from the dispenser when the toilet paper is nearly exhausted from the core. This is particularly true in a dispenser for rolls employing structurally rigid internal supporting hollow cores such as disclosed in the Jespersen U.S. Pat. No. 3,562,600.

Multiple roll dispensers for wound flexible material such as toilet tissues have also been proposed in the prior art wherein the respective rolls in the dispensing and reserve positions within the dispenser are maintained out of contact. In other words, the reserve roll is not resting on the lower roll during dispensing of web material from the lower roll. Frequently this type dispenser has a lever system interengaged between the two rolls, the lever system serving to hold the upper roll in a reserve position until the lever sensing that the roll in the dispensing position is almost or fully exhausted of toilet tissue, or that the roll support spindle or mandrel has fallen out of the dispensing position. In these lever control systems for multiple roll dispensers, the core or spindle on the lower roll in dispensing position is either fully discharged from the dispensing position before release of the reserve roll or a rigid spindle or mandrel is involved which is manually displaced while kept captive in the dispenser to effect release of the reserve roll.

Jespersen U.S. Pat. No. 3,770,222 may be noted as exemplifying the type multiple roll dispenser where the reserve roll is maintained by a lever system in the upper part of the dispenser cabinet out of contact with the roll from which toilet tissue is being dispensed. In the dispenser of this patent, the core on its support spindles is either completely dropped out of the cabinet before release of the lever for the reserve roll to drop into the dispensing position or the spindle is captured in a discard pocket within the dispenser cabinet before the reserve roll is able to be released to move to dispensing position.

Unfortunately, toilet tissue dispensers to handle multiple rolls found in the prior art have been characterized by a number of drawbacks and disadvantages. Where the reserve roll rides upon the lower roll from which toilet tissue material is being dispensed, both of these rolls tend to be turned as the paper is dispensed. Inasmuch as toilet tissue rolls often become slightly telescoped during their shipment, thereby increasing their overall roll length as compared with a squarely round roll, excessive friction and drag is created when the slightly telescoped reserve roll turns and rubs against the side plates of the dispenser cabinet.

In other multiple roll dispensers where the roll that is in use is dropped from the dispenser when web material is substantially exhausted from the roll in the dispensing position, unused toilet tissue still remains on the roll core, thus creating a waste of such tissue. Other roll dispensers require complicated and costly mechanisms to transfer the reserve roll to the dispensing position once the core or spindle for the roll in dispensing position has been discharged from such dispensing position. The instant invention seeks to solve the above mentioned and other disadvantages found in prior art tissue dispensers.

SUMMARY OF THE INVENTION

The dispensing method invention herein dispenses flexible web material from rolls that are wound on readily deformable hollow cores by holding a first roll at a roll dispensing position in a manner that its displacement from such position is prevented without physically deforming the readily deformable hollow core of this first roll. Axial forces are applied to the upper portions of the ends of the hollow core of this first roll tending to buckle the core downwardly. Since the hollow core is not exposed until the web material wound on the core has been exhausted, the method utilizes the presence of this hollow core at the dispensing position to retain a second roll of web material at a reserve roll position.

Once the hollow core is exposed by exhausting web material from the first roll then the exposed hollow core is physically deformed downwardly, assisted by the axial forces applied to the upper portions of the ends of the first roll hollow core, thereby enabling removal of this core from the dispensing position. That act of physically deforming and removing the exposed hollow core from the dispensing position thereupon releases the second roll which has been retained in a reserve roll position by reason of the presence of the hollow core at the dispensing position with the reserve roll then moving to the dispensing position.

Generally, the dispenser apparatus for carrying out the method of dispensing described above employs upwardly facing saddles which close the lower ends of a pair of opposed tracks, these tracks extending upwardly from a roll dispensing position to an upper reserve roll position within the dispenser housing, the tracks guidingly receiving roll core supports projecting from opposite ends of each hollow roll core. By providing upwardly facing saddles closing the lower ends of these tracks, the saddles being located at the roll dispensing position of the tracks, the saddles hold the core supports of a dispensing roll against downward displacement from this dispensing position. The support points between the saddles and the core supports are disposed axially outwardly from the points where the axial forces are applied to the upper portions of the ends of the hollow core thereby creating bending moments on the core tending to buckle the core downwardly.

A spring biasing means is mounted on the housing disposed to apply the above mentioned axial force against an upper portion of one end of the hollow core of a roll at the dispensing position. A lever is pivotally mounted on the housing having a lower end to detect the presence of a hollow roll core. The upper end of this lever is disposed to obstruct one of the parallel tracks, obstructing it adjacent the upper end of the housing when the presence of the hollow roll core is detected by the lower end. The upper end then acts to retain a reserve roll in the reserve roll position as long as the hollow core of a roll in the roll dispensing position is detected. Further the lever is spring biased so that the lower end of the lever applies an axial force against an upper portion of the other end of the hollow core of a roll at the dispensing position.

When the lower end of the lever moves inwardly from the dispensing housing side wall on which it is mounted, such event occurring only upon physically deforming the hollow core downwardly assisted by the axial forces applied to the upper portions of the hollow core ends and removal of the hollow core from the dispensing position, the lever means shifts such that the reserve roll is released and the parallel tracks guide movement of the reserve roll down to the dispensing position.

Having the foregoing description of the invention in mind, it is a principal object of the present invention to provide a dispenser for multiple rolls of flexible sheet material wound on readily deformable hollow cores wherein first and second rolls are maintained out of contact within the dispenser by lever means that is released only by phyically deforming the hollow core, assisted by axial forces applied to the upper portions of the hollow core ends, thereby enabling removal of the hollow core that is retained against displacement within a roll dispensing position until manually deformed.

Another object of the invention is to provide a dispenser for multiple rolls of flexible sheet material wound on readily deformable hollow cores wherein the hollow core is held against displacement from a roll dispensing position until physically deformed as assisted by forces applied axially to the upper portions of the ends of the hollow core as required to enable removal of the core from the holding means at the roll dispensing position.

A further object of the invention is to provide a method of dispensing flexible web material from rolls wound on readily deformable hollow cores while applying axial forces to the upper portions of the ends of the hollow core at a dispensing position thereby tending to buckle the core downwardly and physically deforming the hollow core downwardly assisted by these axial forces once the hollow core is exposed by exhausting web material from the roll.

The above and other objects of the invention will become apparent from consideration of the following detailed description of a preferred embodiment thereof given in conjunction with the accompanying drawings.

DESCRIPTION OF A PREFERRED EMBODIMENT

Figure 1:
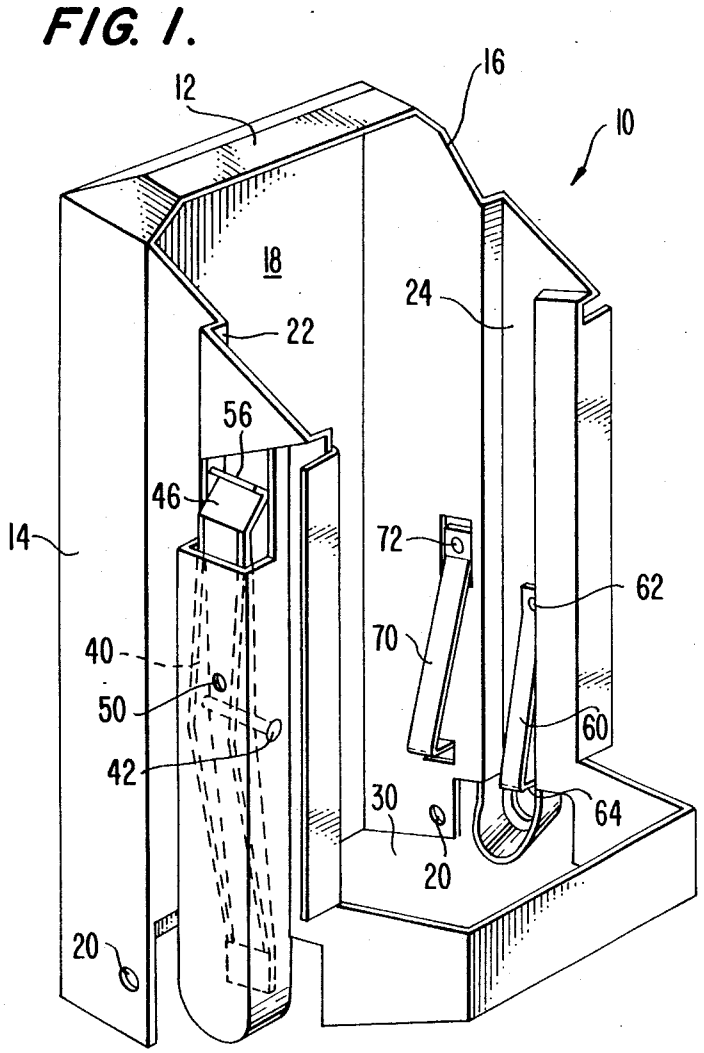
FIG. 1 is a perspective view showing the dispenser housing in accordance with the invention having operating components mounted thereon with the conventional dispenser cover removed.

In describing the dispenser 10 for rolls of wound flexible web material as it is shown on the drawings, and particularly FIG. 1, it should be pointed out that to facilitate illustrating structural features of the invention the usual cover that would conventionally be provided has not been shown on the drawings. Reference may be made to Jespersen U.S. Pat. No. 3,437,388 for an exemplification of how a conventional cover completing the dispenser cabinet may be pivotally mounted in relation to the housing 12 forming the chassis for the working components of the dispenser.

Figure 3:
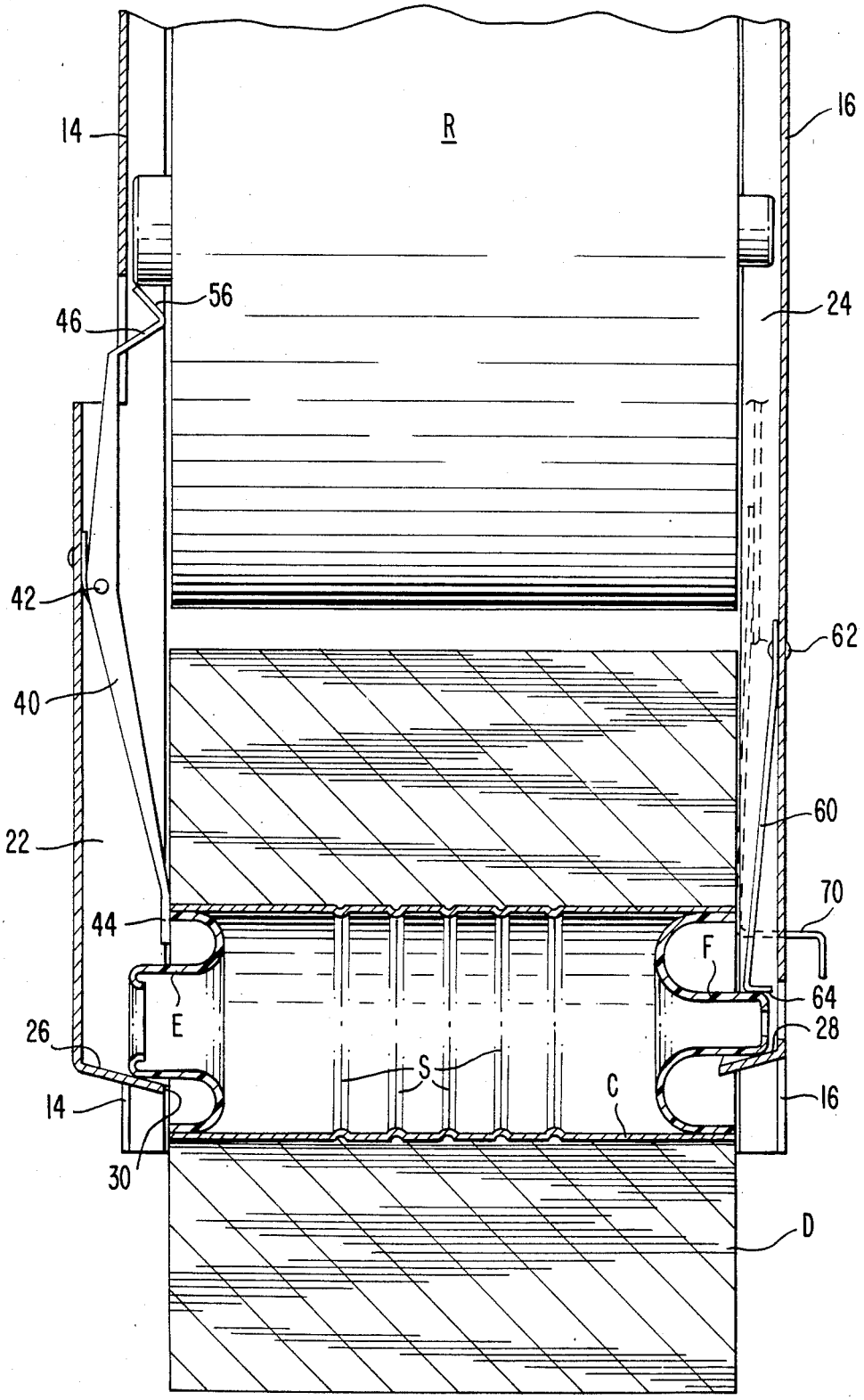
FIG. 3 is a sectional view showing a roll in section in the dispensing position and a reserve roll retained in the reserve roll position.
Figure 6:
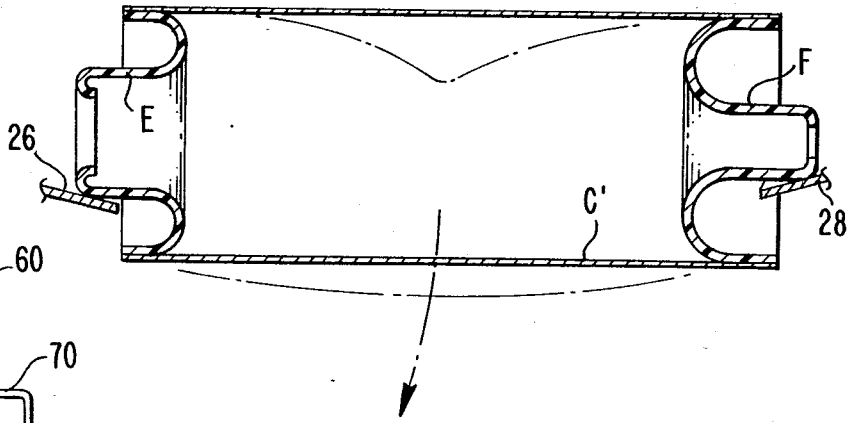
FIG. 6 is a sectional view showing a modified form of readily deformable hollow core from that illustrated in FIG. 4.

With reference to the terminology employed herein, it is to be understood that in referring to rolls of flexible web material wound on readily deformable hollow cores it is intended that the term readily deformable hollow core be construed to include a tubular or cylindrical core made of light weight paperboard such as shown in FIG. 6 so as to be readily deformable or of a core construction as shown in section on FIG. 3 wherein the core intermediate its ends is scored or otherwise weakeded to make it readily deformable. The flexible material in the form of toilet paper is conventionally wound on this readily deformable hollow core together with end caps which may be molded of plastic and inserted into the tubular core to provide the roll core support spindles projecting outwardly from the end of the core within the roll.

Referring to FIG. 1 on the drawings in describing the dispenser 10, the housing 12 provides a first side wall 14, a second side wall 16 and a back wall 18. It will be understood that in use of dispenser 10 the housing 12 forming the chassis for the working components of the dispenser will be approximately mounted on a wall at the desired location for dispenser use. Thus, the back 18 of housing 12 will be provided with appropriate openings (not shown) to accommodate the fasteners employed in affixing dispenser 10 to the desired wall location.

As has been mentioned above, the conventional cover which along with housing 12 completes the dispenser cabinet is not shown. Side walls 14 and 16 are provided with aligned holes 20, these holes serving as pivot points to mount the dispenser cover such as suggested in the dispenser of Jespersen U.S. Pat. No. 3,437,388.

Side wall 14 of housing 12 is provided with an inwardly facing channel 22. Likewise, the opposite side wall 16 is provided with an inwardly facing channel 24. As may be best visualized from FIGS. 3 and 4, this pair of inwardly facing channels 22 and 24 serves to guidingly receive the spindles which form part of the roll core and serve as the roll core supports where they project from the opposite ends of the rolls when the rolls are loaded into dispenser 10.

Preferably the channels 22 and 24 are of different widths to accommodate different diameter spindles forming the roll core supports for the rolls that are loaded into dispenser 10. These different width channels mate with different diameter roll core support spindles to insure the proper unwinding direction and roll orientation in loading the rolls into dispenser 10. However, in the structure of dispenser 10 where the pair of rolls loaded into the dispenser are maintained out of contact with each other in the manner which will be explained, the particular direction of winding or unwinding of the rolls used in the dispenser is not totally critical to dispenser operation.

In any event, the feature of different width guide tracks accommodating different diameter roll core supports spindles is known and discussed in the above mentioned Jespersen U.S. Pat. No. 3,437,388.

Each of the guide track channels 22 and 24 in the side walls 14 and 16 of housing 12 is provided at its lower end with a saddle member, this member being numbered 26 at the bottom of channel 22 and 28 at the lower end of channel 24. It may be noted that the bottom of housing 12 is open at 30 such that the roll D retained in the roll dispensing position at the bottom of dispenser 10 projects downwardly through open bottom 30 as shown on FIGS. 3 and 5 for the web material on roll D to be accessible from dispenser 10 to the intending user.

Referring to FIG. 3, the make up of roll D may be described as exemplifying the type of rolls of flexible web material contemplated for dispensing in the dispenser 10 of this invention. Thus, roll D has the flexible web material wound on a tubular hollow roll core C. In the form of roll core illustrated on FIGS. 3 and 4, the core C is rendered readily deformable by having a series of spaced circumferential score lines S formed intermediate the ends of the core. It will be understood that other weakening techniques may be employed to render the core readily deformable once the wound web material initially carried on the core has been exhausted.

Another form of readily deformable hollow core C′ is illustrated in FIG. 6. In the type of core C′ the core is formed from a light weight material such that the forces applied to the core as described hereinafter to enable easy removal of the hollow core are sufficient to physically deform the core without the necessity for weakening scores S such as shown in the readily deformable core on FIGS. 3 and 4.

In the form of roll core illustrated, the roll core supports for either core C or C′ are provided by an end cap E inserted in the outer end of the tubular hollow core and an end cap F inserted in the tubular hollow core at the opposite end. It will be seen from FIG. 3 how the core support spindle of end cap E engages in the saddle member 26 at the bottom of channel 22 and the core support spindle of end cap F engages in the saddle member 28 at the bottom of channel 24 to support roll D in the roll dispensing position within the housing 12 of dispenser 10. As so supported, the toilet paper material on roll D projects down through the open bottom 30 of housing 12.

As illustrated on the drawings, the open bottom 30 is defined within the side walls 14 and 16, and back wall 18 of housing 12, these walls extending down beneath saddle members 26 and 28. Generally, with the dispenser cover (not shown) in place, the cover in association with the housing 12 might take the configuration shown in the above discussed Jespersen U.S. Pat. No. 3,437,388. With such a configuration the toilet paper material on roll D is exposed through the open bottom 30 of dispenser 10. It will be understood that the roll R partially shown on FIGS. 3 and 4 as it is retained in a reserve roll position within housing 12 would have a similar make up to the make up that is hereinabove described with reference to roll D.

The operating control for the dispenser 10 as between the two rolls D and R loaded into the housing 12 is provided by a control lever 40. This lever is pivotally mounted in channel 22 of side wall 14 on pivot pin 42. This pivotal mounting enables pin 42 to simply pass through the sides of channel 22 to effect the desired mounting of control lever 40.

Lever 40 has a lower sensing end 44 which serves to sense the presence of a hollow roll core C. As will be explained, this lower end also applies an axial force $F_L$ (FIG. 4) to the upper portion of the end of the hollow core C. This sensing of a hollow roll core such as that of roll D as shown on FIG. 3 occurs when this first roll is retained at the roll dispensing position within housing 12. An upper support end 46 on pivotally mounted lever 40 serves to retain a second roll R in the reserve roll position within housing 12 such as roll R also shown on FIG. 3.

Figure 2:
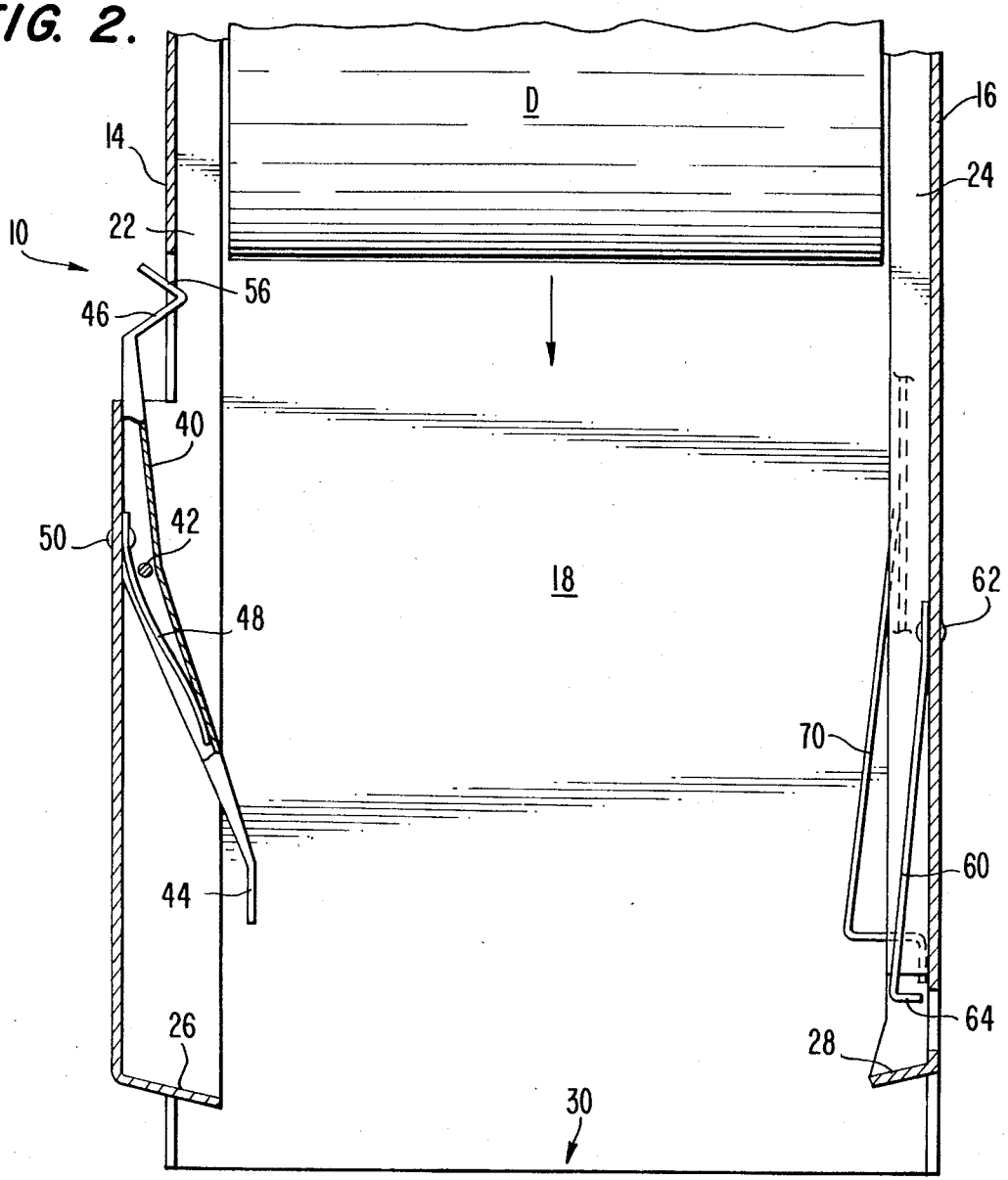
FIG. 2 is a sectional view showing a roll entering the upper end of the housing with the parts at the dispensing position in readiness to receive the roll.

A leaf spring 48 which may be rivoted at 50 to the outer wall of channel 22 serves to bias control lever 40 toward the position as shown in FIG. 2. The biasing force of spring 48 thus urges the sensing end 44 of lever 40 toward the roll dispensing position within housing 12. It consequently urges support end 46 of lever 40 away from the reserve roll position within housing 12 also as shown on FIG. 2. More importantly the biasing force of leaf spring 48 applies the force $F_L$ to the upper portion of one end of the hollow core C.

Figure 4:
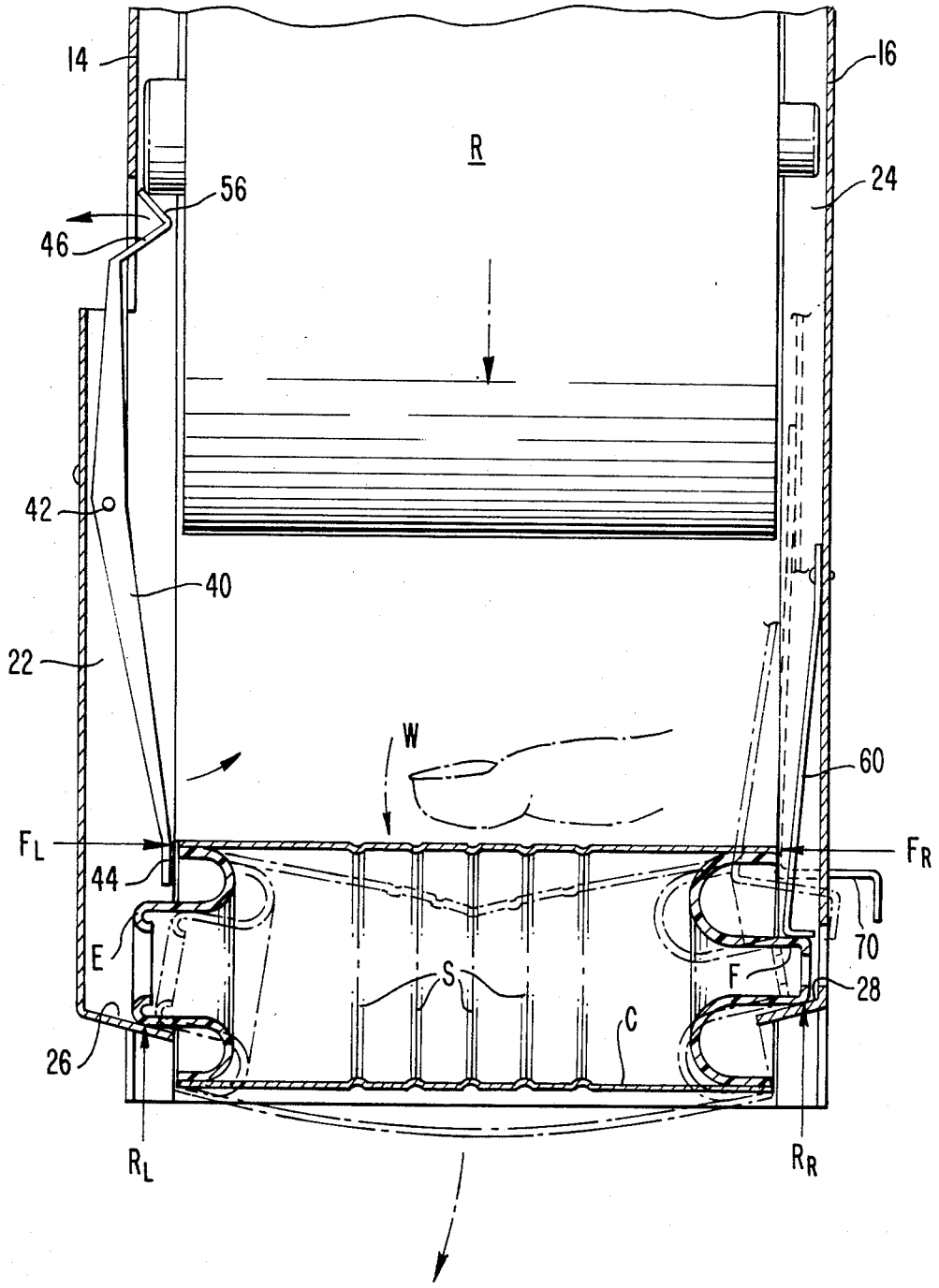
FIG. 4 is a sectional view similar to FIG. 3 showing an empty hollow roll core in the dispensing position indicating the forces operating to effect physically deformed removal of the hollow core.

The upper support end of control lever 40 is formed with a reverse bend in the embodiment shown such as to provide a surface 56 which is inwardly inclined relative to the plane of the first side wall 14 of housing 12. This inclined surface 56 physically engages with the roll core support spindle such as shown in FIGS. 3 and 4 with reference to roll R retained in the reserve roll position within housing 12 of dispenser 10.

As will be apparent from the showing on these figures, the inward inclination of surface 56 on the upper support end 46 of lever 40 tends to utilize the weight of roll R acting down on the spindle resting on inclined surface 56 in a manner tending to urge lever 40 and its upper support end 46 outwardly from blocking track 22. Thus the weight of roll R promotes the action of the lower end 44 of lever 40 in pressing inwardly against the upper portion of the end of core C thereby providing an added biasing force against core C tending to buckle the readily deformable core upon exhaustion of web material.

The second side wall 16 of housing 12 is provided with a spring biased latch 60 which may be rivoted at 62 to the outer wall of channel 24 for this latch 60 to lie within channel 24. The spring biased latch 60 has its lower end 64 spaced above saddle member 28 at the bottom of channel 24. Thus it is spaced sufficiently above such saddle member that the spindle of end cap F on the hollow core C may freely rest on saddle member 28 beneath the end 64 of latch 60 as shown on FIGS. 3 and 4.

It will be understood that as the spindle of end cap F moves down along the guide track channel 24 this spindle will act to depress latch 60 until it moves beneath the latch end 64. In this position reverse movement along the guide track 24 is blocked by latch 60. This blocking action serves to prevent the right end of roll D (as seen on FIG. 3) from being raised up within housing 12 of the dispenser thus preventing pilferage of full or partial toilet paper rolls from the dispenser 10. It will be recognized that the left end of roll D is likewise prevented from being raised back up within channel 22 by the lower sensing end 44 of lever 40 overlying the spindle on end cap E, again as shown on FIGS. 3 and 4.

The second side wall 16 of housing 12 is also provided with a biasing leaf spring 70. This spring may have its upper end suitably rivoted at 72 to side wall 16. Spring 70 is positioned adjacent the roll dispensing position within housing 12 to project inwardly and perform two functions. Initially, with a full roll D such as shown in FIG. 3 spring 70 applies a frictional resistance to one end of the roll which is retained in the roll dispensing position. This function of the spring 70 acts to retard rotation of roll D or the roll disposed in the dispensing position so that it does not freely revolve or spin as web material, such as toilet paper, is withdrawn from dispenser 10 by the intending user. Importantly, leaf spring 70 applies an axial force against the upper portion of one end of the hollow roll core C, this force being identified $F_R$ on FIG. 4.

Operation of the dispenser 10 as hereinabove described may now be explained. In FIG. 1 the dispenser housing 12 is shown in its empty or unloaded condition. The sectional view of FIG. 2 shows the initial or first roll D as it is being loaded with its core support spindles (not shown) guidingly engaging with the track channels 22 and 24 as the roll passes down into the dispensing position at the lower end of housing 12.

In FIG. 3, roll D is shown with its support spindles on the hollow core C resting on the saddle members 26 and 28 of channels 22 and 24, respectively. In this position, roll D has the material thereof exposed through the open bottom 30 of housing 12 for ready access to the intending user. Further in FIG. 3, the second or reserve roll R has been loaded into the housing by its spindles being entered into the upper ends of channels 22 and 24, respectively.

But, the presence of roll D as it passed down into the dispensing position location has shifted lever 40 such that the upper support end 46 of such lever has been moved into channel 22 to form a stop within channel 22. As shown on FIG. 3 the left spindle of roll R has come into engagement with this stop by the spindle resting on the inclined surface 56 of upper support end 46 of lever 40.

It will be recognized that the biasing spring 70, as best seen on FIG. 1 has been compressed by the downward movement of roll D such that spring 70 is applying frictional resistance to retard free rotation of roll D. Likewise the downward movement of the spindles of roll D into engagement with saddle members 26 and 28 has caused the spindle on end cap F to pass beneath the latch end 64 on spring biased latch 60. Accordingly, with the roll sensing end 44 of lever 40 overlying the left spindle on roll D and the end 64 of spring biased latch 60 overlying the right spindle of roll D, any attempt to raise the roll D is effectively blocked by these two elements overlying the core support spindles on the opposite ends of roll D.

The above described condition of rolls D and R as shown on FIG. 3 where they are both retained in their respective dispensing and reserve roll positions will continue while utilization of web material from roll D is taking place by the toilet paper web being withdrawn by intending users. Also during the use of web material from roll D the control lever 40, especially under the biasing force of spring 48 will be continuously sensing the hollow roll core C. Thus, the second roll R in the reserve roll position is continuously retained in this position during the sensing of hollow roll core C.

As will be seen from FIG. 3, the diameter of rolls R and D in relation to the length of lever 40, where such lever extends above its pivot pin 42, is such as to maintain these full rolls R and D out of contact with each other. Thus, with this particular full size roll and length of pivotally mounted lever 40, rolls R and D will be continuously maintained out of contact with each other as web material is being withdrawn from roll D.

The sensing of the hollow core C of roll D is thus employed to continue retention of roll R in the reserve roll position with the two rolls out of contact with each other at least when the core of roll D approaches becoming empty so that in this latter stage of exhausting roll D there is no friction between the reserve roll R and roll D. The important concept is that sensing of the intact core of roll D be utilized to continue retention of roll R in the reserve roll position and at least retain the two rolls out of contact with each other during the stage when roll D nears exhaustion of its web material.

When the web material is fully withdrawn and roll D becomes exhausted the condition shown on FIG. 4 exists. At this time, the reserve roll or second roll R is still retained in the reserve roll position at the upper end of housing 12. However, the lower sensing end of 44 of lever 40 as it presses axially against the upper portion of the end of hollow roll core C urges buckling of the core upon occurrence of exhaustion of web material from hollow core C.

The forces acting on the readily deformable hollow core C may best be described by reference to FIG. 4 and the reference characters displayed thereon. The full roll D has the spindles of its core end caps E and F supporting the roll wound on hollow core C resting in the saddles 26 and 28, respectively. As shown in FIG. 3, when the web material making up roll D becomes exhausted the weight of core C and its end caps E and F is still resting on the saddles 26 and 28 as shown in FIG. 4. Thus, there are reaction forces $R_L$ and $R_R$ acting along the lines of the arrows shown at the left and right where the spindles contact the saddles.

At the same time axial forces are being applied to the upper portion of the opposite ends of core C by the lower end 44 of spring biased lever 40 and the leaf spring 70 on the other side of the dispenser cabinet 12. These axial forces are represented by the arrows $F_L$ and $F_R$ on FIG. 4.

These axial forces applied from the left and right identified $F_L$ and $F_R$ in and of themselves tend to buckle the core C downwardly by their being applied to the upper portions of the opposite core ends. This downward buckling of core C is further promoted by the force $F_L$ generating a twisting moment about the contact point where the spindle of end cap E engages with saddle member 26 resisted by the reaction force $R_L$. Similarly, the force $F_R$ acting against the opposite end of the core C produces a twisting moment about the contact point of the spindle of end cap F resisted by the reaction force $R_R$. These two twisting or turning moments applied at the opposite ends of the hollow core C further promote downward buckling of the readily deformable core C. Thus, when web material is exhausted from core C so that such material is not present to strengthen the readily deformable core, a slight downward assisting pressure W applied manually as depicted on FIG. 4 enables easy removal of core C from being held in saddles 26 and 28 at the dispensing position within dispenser 10.

Summarized, still referring to FIG. 4, the axial forces $F_L$ and $F_R$ place the upper surface of core C under compression thereby tending to buckle it. Additionally the turning moments between $F_L$ and $R_L$, and $F_R$ and $R_R$ at each end tend to twist the buckled core downwards and out of the dispenser when a minimal force W is applied to the upper surface of core C, thereby making easy removal of the core and its end caps E and F. Thereupon the hollow core C disengages from the track channels 22 and 24 and their saddle members 26 and 28, falling out of the bottom 30 of dispenser housing 12.

This frees lever 40, especially under the urging of leaf spring 48, to move to a position as shown in FIG. 2. Such movement of the lever 40 shifts the sensing end 44 into the roll dispensing position area and likewise shifts the support end 46 of lever 40 away from the reserve roll position area thereby opening track guide channel 22 such that the spindles of roll R are now freed for this roll to move down into the dispensing position at the bottom of housing 12.

Figure 5:
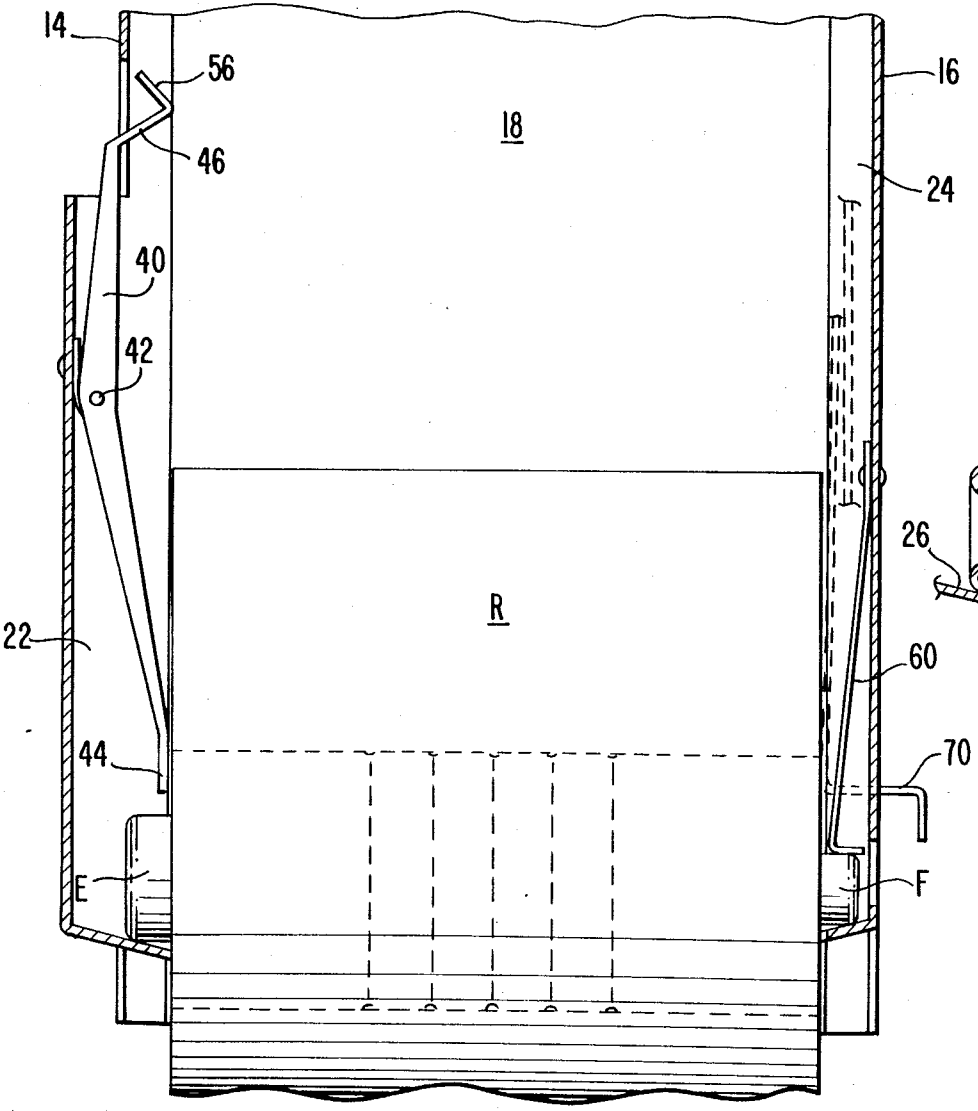
FIG. 5 is a sectional view showing a full roll in the dispensing position.

This condition for roll R is shown on FIG. 5. From this figure it will be noted that the lever 40 has again been shifted by its lower sensing end 44 detecting the hollow core C within roll R. This shifting of lever 40 again moves the upper support end 46 of lever 40 into a position to block track channel 22.

Thereafter, in loading a new roll into the dispensing housing 12, by entering its outwardly projecting roll core support spindles into the opposite channels 22 and 24, this new roll can only pass down these channels to a point where one of its spindles encounters the upper support end 46 of lever 40 which is blocking the channel 22. Again this new roll will be held in reserve until such time as the roll located in the roll dispensing position resting on the saddle members 26 and 28 has been exhausted. Upon exhaustion of material from this latter roll, the buckling forces acting on the opposite ends of the readily deformable core C, assisted by a minor downward pressure W, will physically deform the core C for its removal from the track channels and saddle members.

While the foregoing is believed to constitute a complete description of a preferred embodiment of the invention, it is to be recognized that various modification, changes, alterations, etc. may well appear to those skilled in the art. Therefore, the invention is not considered to be limited by the specifics of the disclosed embodiment, but rather to be embrasive of all subject matter falling within the terms of the hereinafter appended claims or their equivalents.

We claim:

1. A method of dispensing flexible web material from rolls that are wound on readily deformable hollow cores comprising the steps of:

holding a first roll at a roll dispensing position against displacement from said position without physically deforming the readily deformable hollow core of said first roll;

utilizing the presence of said hollow core at said dispensing position to retain a second roll of material at a reserve roll position;

applying axial forces to the upper portions of the ends of said hollow core tending to buckle said core downwardly;

exposing said hollow core of said first roll by exhausting web material from said first roll;

physically deforming said hollow core downwardly, assisted by said axial forces applied to said upper portions, to enable removal of said core from being held at said dispensing position; and releasing said second roll from said reserve roll position for movement to said dispensing position upon said physically deformed removal of said hollow core from said dispensing position.

2. A method of dispensing flexible web material as recited in claim 1 comprising the further step of circumferentially weakening at least one portion of said hollow core intermediate said core ends to provide said readily deformable hollow core.

3. A method for dispensing flexible web material as recited in either claim 1 or 2 wherein said holding a first roll and retaining a second roll includes maintaining said first and second rolls out of contact with each other.

4. A method of dispensing flexible web material as recited in claim 3 wherein releasing said second roll for movement to said dispensing position includes supporting said second roll for guided movement from said reserve roll position to said roll dispensing position.

5. A dispenser for rolls of flexible web material wound into a roll on a readily deformable hollow core comprising:

an upstanding housing providing opposed parallel track means extending upwardly from a roll dispensing position to an upper reserve roll position within said housing to guidingly receive roll core supports projecting from opposite ends of each hollow roll core;

upwardly facing saddle means closing the lower end of each said track means at said roll dispensing position to hold the core supports of a dispensing roll against downward displacement from said dispensing position;

biasing means mounted on said housing disposed to apply an axial force against an upper portion of one end of the hollow core of a roll at said roll dispensing position;

lever means pivotally mounted on said housing having a lower end disposed to detect the presence of the hollow core of a roll at said roll dispensing position and an upper end disposed to obstruct at least one of said track means adjacent the upper end of said housing when the presence of such hollow core is detected, said upper end acting to retain a reserve roll in said reserve roll position when said lower end detects the hollow core of a roll in said roll dispensing position; and spring means biasing said lower end of said lever to apply an axial force against an upper portion of the other end of the hollow core of a roll at said roll dispensing position, said lower end shifting inwardly of said housing when the hollow core is physically deformed as assisted by said axial forces for removal of the core whereupon the reserve roll is released and said parallel track means guide movement of the reserve roll to said dispensing position.

6. A dispenser for rolls of flexible web material as recited in claim 5 wherein said lever means includes a pivot in one of said track means, a lever mounted on said pivot, said pivot being disposed intermediate said lower and upper ends of said lever, and said biasing means is provided by a spring mounted adjacent the other of said opposed parallel track means.

7. A dispenser for rolls of flexible web material as recited in claim 6 wherein said spring is provided by a leaf spring having one end fixedly mounted adjacent said other track means and the other end projecting out to press against the upper portion of one end of the hollow core of a roll at said dispensing position.

8. A dispenser for rolls of flexible web material as recited in any of claims 5, 6 or 7 wherein said parallel track means are provided by a pair of inwardly facing channels and said saddle means are provided by semicircular walls closing the lower ends of said channels.

* * * * *